United States Patent [19]

Essmeier

[11] 3,938,600

[45] Feb. 17, 1976

[54] HYDRAULIC MINING NOZZLE-AIR LIFT DEVICE

[75] Inventor: Donald E. Essmeier, New Orleans, La.

[73] Assignee: Continental Oil Company, Ponca City, Okla.

[22] Filed: Feb. 26, 1975

[21] Appl. No.: 553,386

Related U.S. Application Data

[60] Division of Ser. No. 379,671, July 16, 1973, abandoned, which is a continuation-in-part of Ser. No. 181,896, Sept. 20, 1971, abandoned.

[52] U.S. Cl. ..... 175/422; 175/67

[51] Int. Cl.[2] ..... E21B 7/18

[58] Field of Search ..... 166/222, 223; 175/62, 67, 175/69, 100, 213, 215, 324, 422; 61/53.74, 82, 46

[56] References Cited

UNITED STATES PATENTS

| | | | |
|---|---|---|---|
| 538,073 | 4/1895 | Harris | 175/67 |
| 1,853,379 | 4/1932 | Rotinoff | 175/67 X |
| 2,239,610 | 4/1941 | Kuna | 175/324 X |
| 2,660,250 | 11/1953 | Gage et al. | 166/222 X |
| 2,931,187 | 4/1960 | Perkins | 175/67 X |
| 3,153,290 | 10/1964 | Saito | 166/222 X |
| 3,260,054 | 7/1966 | Lorenz | 175/62 X |
| 3,262,508 | 7/1966 | Price | 175/422 X |
| 3,331,456 | 7/1967 | Pittman | 166/222 X |
| 3,597,930 | 8/1971 | Rochelle | 61/46 |

*Primary Examiner*—David H. Brown

[57] ABSTRACT

A hydraulic nozzle device for removing soil from the interior and below a hollow structure.

7 Claims, 9 Drawing Figures

HYDRAULIC MINING NOZZLE-AIR LIFT DEVICE

This is a division of application Ser. No. 379,671, filed July 16, 1973, now abandoned, which is a continuation-in-part of application Ser. No. 181,896, filed Sept. 20, 1971, now abandoned.

BACKGROUND OF THE INVENTION

1. Field of the Invention

This invention relates to an apparatus for hydraulically forming an opening in compacted particulate matter. More particularly, this invention relates to an apparatus for loosening and removing tightly compacted particulate matter, such as sand, gravel, or shale, and to process for rapidly sinking a hollow structure through strata of such particulate matter, specifically a subsurface soil formation, such as for setting piling for an offshore structure with a hydraulic nozzle using a non-solvent fluid.

2. Prior Art

Known methods for driving structures, such as piling through sand, gravel, or shale, consist of mechanically driving the structure through the soil strata. It has been known to loosen tightly compacted strata using various types of conduit or perforated structures to pump fluid, i.e., water or air, into the strata near the driven structure. These methods require continuous loosening while the structure penetrates the strata; they are limited to loosening soil in the area immediately adjacent the structure. They do not remove the soil from the interior of the structure or substantially ahead of the structure.

The prior art does not provide a hydraulic mining nozzle device which can be efficiently used to evacuate soil within and to form a hole of controlled shape and depth beyond a hollow structure. The prior art does not provide an efficient hydraulic-pneumatic lift means for removing cuttings from a hydraulic nozzle. The prior art does not provide a hydraulic nozzle with centralizers, rear jets, or side jets to permit cutting beyond a hollow structure and to prevent sticking such a nozzle in soft soil formations.

SUMMARY OF INVENTION

By this invention there is provided apparatus which does not have the serious disadvantages of prior art devices for rapidly loosening and removing tightly compacted particulate matter, such as granular soil, from the interior and substantially beyond a hollow structure. The apparatus is adapted to be portable and readily movable into and back through the hollow structure. It functions independently of the hollow structure, even in shale formations. The apparatus of this invention can attain a penetration rate in excess of about 7 meters per hour and extend up to about 20 meters beyond the hollow structure in normal granular soil.

This invention also provides a nozzle apparatus for rapidly removing soil within and substantially beyond a hollow structure, such as a piling being driven into the ground. The features of the nozzle are adapted to cooperate for deeper and faster penetration of granular strata. Yet, the sole source of power for loosening and removing the particulate matter is projected hydraulic fluid so that the nozzle does not require a solvent or auxiliary power. This invention is especially adapted for clearing soil from the interior of a hollow structure and for cutting a hole of controlled shape and depth beyond the end of the hollow structure. The shape of the hole beyond the structure will be substantially cylindrical so that problems of caving are minimized.

By this invention there is provided a hydraulic nozzle for loosening and removing tightly compacted particulate matter comprising a cutting envelope formed by a generally cylindrical sheath opening at the front end and partially closed at the rear end by an annular partition connecting the sheath and an evacuation conduit, a cutting means consisting essentially of a hydraulic jet mounted in said sheath near the rear side periphery of the envelope to project a stream of non-solvent hydraulic fluid toward the front opening of the sheath at an angle of inclination of between about 20°–120° between the jet axis and a line from the base of the jet perpendicular to the longitudinal center line axis of the sheath, the evacuation conduit extending rearward of said envelope to remove loosened particulate matter and hydraulic fluid from the envelope to a disposal means, and a hydraulic fluid conduit connecting said jet and a hydraulic fluid supply means. The sheath and jet are adapted to project the hydraulic fluid and focus the fluid stream creating a cutting action centralized in front of the sheath. This creates a cutting face in front enabling the nozzle to attain high efficiency and cutting rate. The projected hydraulic fluid is also the sole source of energy required to suspend and remove matter from the sheath through the evacuation conduit.

DESCRIPTION OF THE INVENTION

Figure 1:
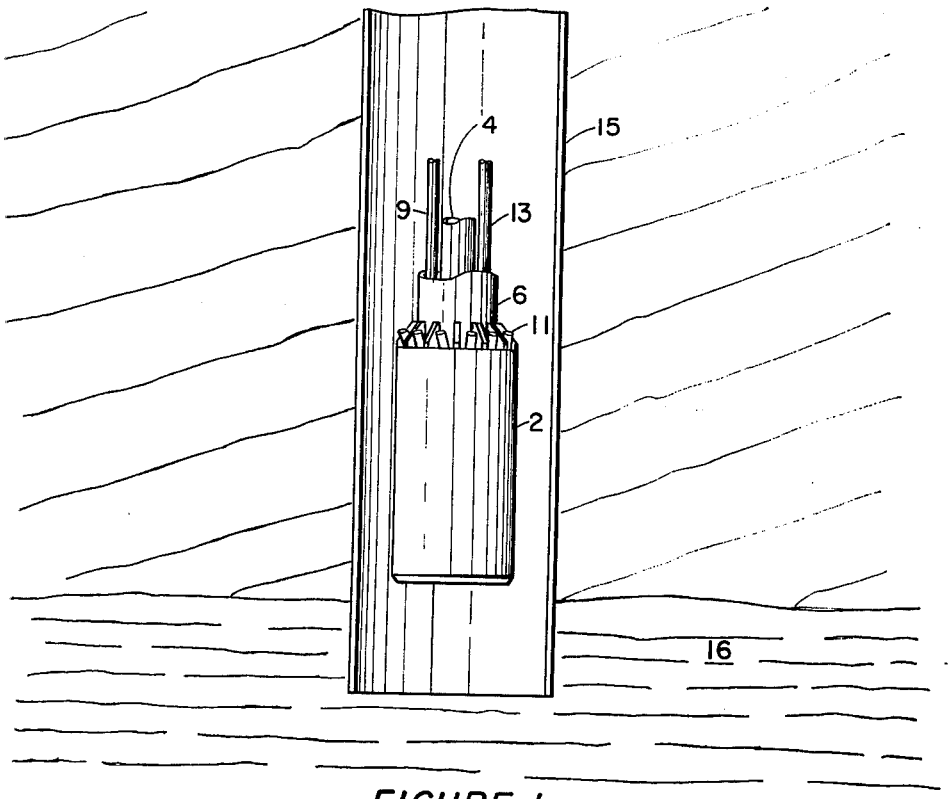
FIG. 1 is a representation of the apparatus of this invention as used in a hollow structure.

Essential features of the apparatus of this invention are (1) the sheath which forms a cutting envelope and directs the hydraulic fluid, which forms a fluid cutting means, (2) the cutting means comprising the hydraulic jet which serves to project fluid against the soil strata as the sole source of energy for loosening particles to be removed and to suspend particles being removed, and (3) the evacuation conduit which serves to remove loosened particulate matter and hydraulic fluid. These features are designed and located in the nozzle as shown herein to cooperate, thereby developing high efficiency in cutting through and removing soil strata using only hydraulic fluid action as the source of primary cutting energy. These essential features are connected by an annular partition so that the conduit receives the fluid and particulate slurry from the sheath.

This partition can be a simple plate perpendicular to the center line axis of the sheath, it can be a conical partition, or it can be a combination of various configurations. The partition can also be of a simple spider construction which centralizes the evacuation conduit within the supply conduit and sheath.

The hydraulic nozzle of this invention can be designed for use with a particular type of hollow structure and soil strata, or it can be fabricated for use with several types of structures and soil strata. Especially for tightly packed high-density soil, the nozzle is adapted so that the sheath and jet cooperate to project a major portion of the streams of hydraulic fluid toward the front sheath opening forming a high intensity cutting force ahead of the sheath, which shall be referred to herein as a high intensity cutting face. This type of nozzle is illustrated by one having a cylindrical shape with large hydraulic jets directed toward the cutting face. For soft strata with a relatively low density, the nozzle can have a relatively large cutting face which requires a larger proportion of the hydraulic fluid for suspending and removing loosened particles in the envelope than with a nozzle having a smaller cutting face. By using the various adaptations taught herein, a nozzle can be fabricated to give both high penetration rate and economy of operation for various types of soil strata.

In a preferred embodiment, as shown in the drawings, the sheath (2) is cylindrical; the annular partition (3) is perpendicular to the sheath; and 4–48 jets are mounted on the annular partition in one or more circular patterns about the evacuation conduit near the rear periphery of said sheath with one or more manifolds (8 and 10) connecting the various arrangements of jets to hydraulic fluid supply means. The exact number, size, and arrangement of jets are not critical. In another preferred embodiment of this apparatus, the sheath is conical with the larger diameter at the front opening or cutting face of the nozzle.

Figure 3:
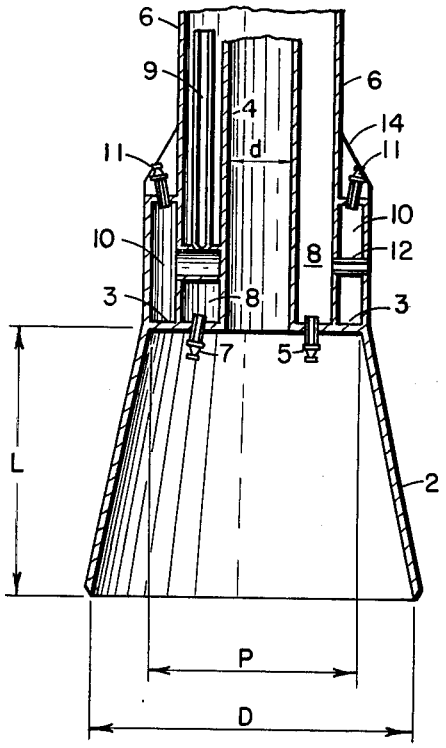
FIG. 3 is a cross-section diagram of a preferred embodiment of this invention with a conical sheath.

The sheath can be beveled at the front edge either on the outer surface, as shown in FIG. 3, or on the inner surface to increase the ease of penetration in the soil strata.

Figure 4:
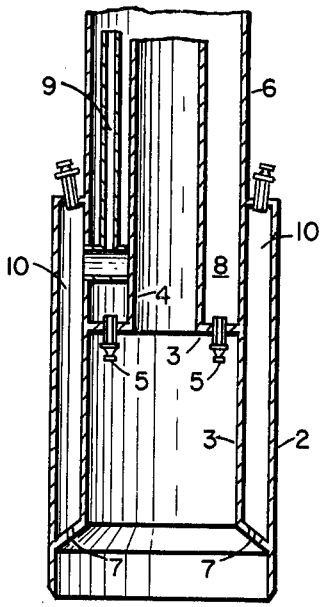
FIG. 4 is a cross-section diagram of a preferred embodiment of this invention with a cylindrical sheath and a complex annular partition.

Operation of the apparatus of this invention can be described with reference to the drawings. As shown in FIG. 1, the hydraulic nozzle is mounted on a support means comprising a relatively rigid hydraulic fluid conduit 6 which preferably extends about 10–50 meters behind the nozzle and evacuation duct 4 is inserted into hollow structure 15 which is being driven into soil. The relatively rigid supporting conduit can be slightly longer than the hollow structure or flexible hose conduit can be connected to the conduit. The nozzle is portable and the support means is adapted to be manipulative so that the nozzle can be inserted into, passed through the piling or hollow structure already in place, and withdrawn back through the piling. Since the projected hydraulic fluid is the only source of energy required for loosening the soil formation, the nozzle is readily portable. Prior to nozzle contact with the soil strata, hydraulic fluid is circulated through conduit 6 to primary jets 5 and secondary jets 7 as shown in FIGS. 3 and 4. Hydraulic fluid fills the hollow structure. Fluid and granular material circulate in the metal sheath and leave the nozzle through evacuation conduit 4. The nozzle is adapted so that the non-solvent hydraulic fluid is the sole source of energy for loosening and suspending particulate matter ahead of the sheath.

A preferred process for using the apparatus of this invention comprises passing the hydraulic nozzle through a hollow structure while, passing hydraulic fluid through the jets to loosen and remove the soil ahead of the nozzle and extending the nozzle substantially beyond the end of the hollow structure so that the cutting means consists essentially of the projected hydraulic fluid. This process is particularly useful for multileg offshore structures having hollow tubing segments or piling where the nozzle can cut about 20 meters below each leg, wherein the hollow structure is appurtenant thereto.

The hydraulic fluid, preferably water, can be supplied and disposed of by any conventional means. It can be pumped from the ocean, circulated through the nozzle, and returned to the ocean for offshore applications. Fluid can be circulated through the nozzle, processed to remove cuttings, and recirculated through the nozzle. Force applied by conventional means, e.g., nozzle weight, advances the nozzle in the hollow structure as the hydraulic nozzle clears the path. The hydraulic fluid is a non-solvent; that is, the particulate matter is loosened and suspended in the hydraulic fluid by momentum of the fluid and not solvent characteristics of the fluid. Optional features which can be used with the hydraulic nozzle are illustrated in FIG. 3 as reinforcing and centralizing stabilizers 14, reverse jets 11, side jets 12, and a secondary hydraulic supply line 9. Reinforcing centralizers serve to strengthen the hydraulic nozzle and facilitate withdrawal of the nozzle back into and through the hollow structure. Reverse jets 11 and side jets 12, as shown in FIG. 3, serve to remove soil and maintain clearance behind and to the side of the nozzle to facilitate withdrawal of the nozzle from the hollow structure and beyond. A secondary supply line 9 and manifold 10 supply hydraulic fluid to the various jets and control distribution of hydraulic fluid for optimum penetration rate and economy of operation. Other optional features, such as stabilizers and centralizers (not shown), can be used on conduit 6 for extending the nozzle substantially beyond the hollow structure 15. Centralizers are especially useful where the conduit 6 is substantially smaller than the nozzle and the hollow structure.

Conventional features, such as turbulence promoters, vanes, cutting teeth or notches, hydraulic fluid additives, and reinforcing members, which do not substantially interfere with the hydraulic cutting and lifting action can be used with the apparatus of this invention. Consisting essentially of as used herein does not exclude such additions and variations which do not substantially interfere with or change the function of any feature of the invention.

Figure 2:
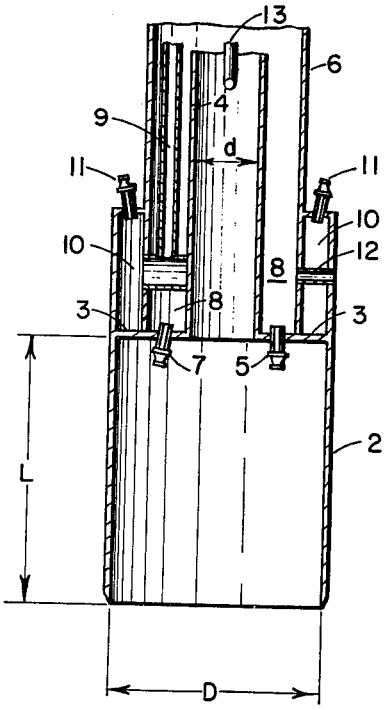
FIG. 2 is a cross-section diagram of a preferred embodiment of the apparatus of this invention with a cylindrical sheath.
Figure 5:
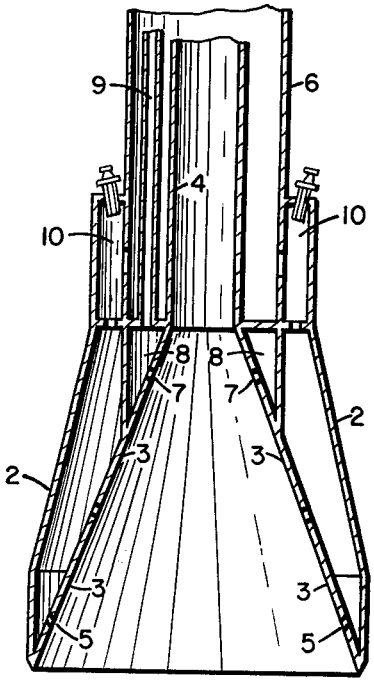
FIG. 5 is a cross-section diagram of a preferred embodiment of this invention with a conical sheath and a conical annular partition.

Distribution of hydraulic fluid in the nozzle is determined by the shape of the cutting envelope, hydraulic fluid pressure, and by the size, number, location, and angle of inclination of hydraulic jets. As shown in the drawings, the cutting envelope is defined by the sheath, annular partition, and evacuation conduit. As shown in FIG. 2, the cutting envelope is cylindrical with primary jets 5 projecting streams of hydraulic fluid toward the cutting face and secondary jets 7 supplying hydraulic fluid for both cutting action and suspending action within the envelope. As shown in FIG. 3, the cutting envelope is conical and both primary and secondary jets project hydraulic fluid toward the cutting face of the envelope. In FIG. 4, the cutting envelope comprises two cylindrical sections with jets 5 projecting streams of hydraulic fluid from the rear of the cylindrical sections and jets 7 focusing the streams of hydraulic fluid forming a cutting face. FIG. 5 shows another variation having a configuration with large primary jets 5 focusing the streams of hydraulic fluid at the front forming a cutting face or projecting fluid so that the fluid momentum is focused to maximize the cutting force ahead of the sheath with secondary jets 7 agitating and suspending loosened particles within the envelope. The nozzle of this invention is specially adapted to focus this cutting action because the jets and sheath are adapted to cooperate in maximizing the momentum available for cutting.

Figures 6A, 6B, 6C:
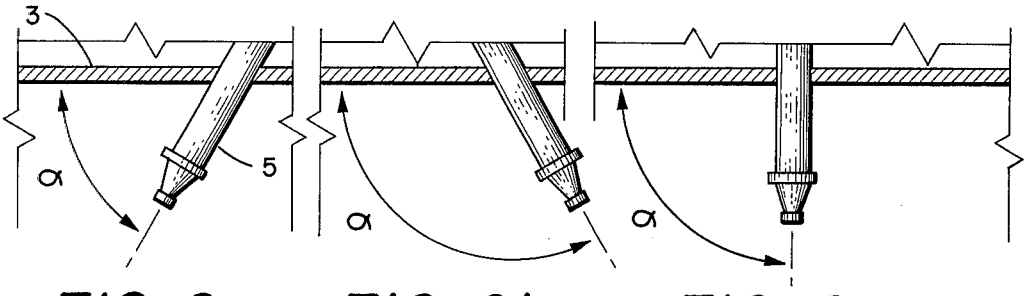
FIG. 6 is an end view of the nozzle shown in FIG. 4 with Views 6*a*, 6*b*, and 6*c* along the Section Lines *a*—*a*, *b*—*b*, and *c*—*c*, showing the location and the angle of inclination (alpha, $\alpha$) of primary hydraulic jets in a preferred embodiment with the secondary jets slanted in a counterclockwise direction about the nozzle axis.
Figure 6:
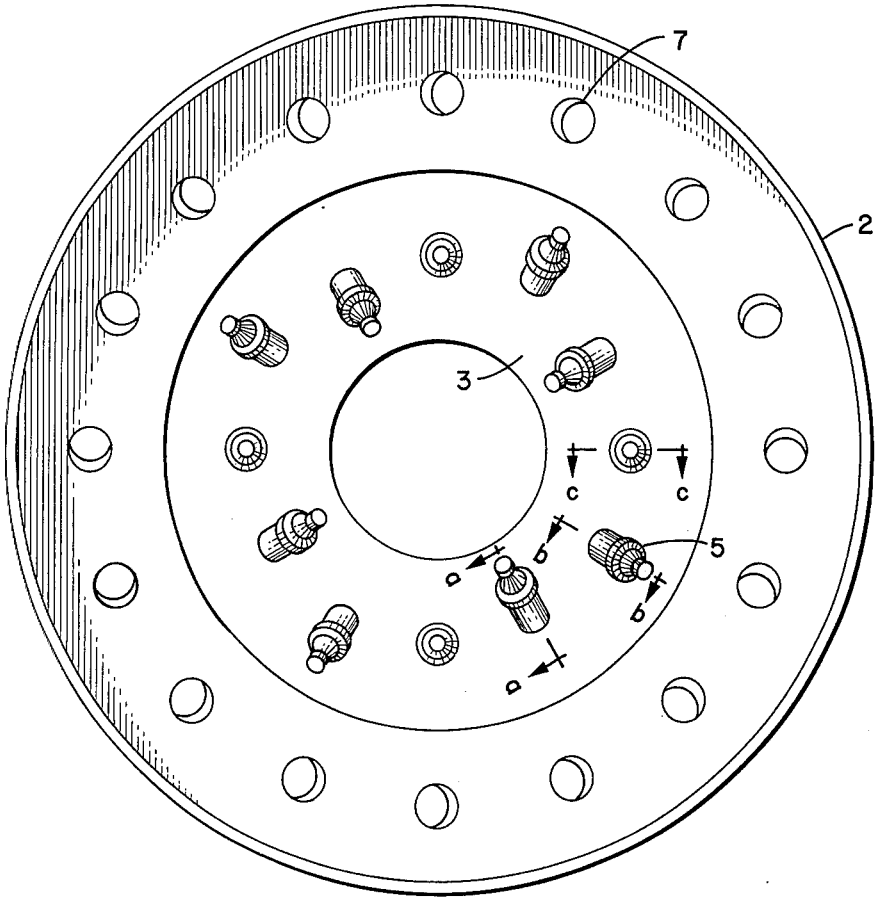

FIG. 6 shows an open-end view of the nozzle of FIG. 4 and the pattern of primary jets 5 and secondary jets 7. The angle of inclination ($\alpha$) of the primary jets is shown in FIGS. 6*a*, 6*b*, and 6*c* along section lines *a—a*, *b—b*, and *c—c*. The secondary jets 7 in FIG. 6 are also shown slanted to create a counterclock fluid flow pattern near the secondary nozzles. The primary jets can also be slanted or inclined to create a clockwise, counterclockwise, or mixing flow pattern as well as being inclined as shown in FIGS. 6*a*, 6*b*, and 6*c*.

The angle of inclination of the jets ($\alpha$) is measured between the axis of the jet and a line from the base center line of the jet, i.e., where it is mounted, perpendicular to the center line axis of the sheath 2. That is, a jet which projects fluid parallel to the center line of the sheath has an angle of inclination of 90°, a jet which projects fluid toward the center line has an angle of inclination (i.e., $\alpha$) of less than 90°, and a jet which projects fluid away from the center line has an angle of inclination greater than 90°.

Jets of the hydraulic nozzle of this invention are preferably arranged in one or more circular patterns about the cutting envelope to project high velocity hydraulic fluid, preferably water, against compacted soil strata at the front or cutting face of the envelope. The exact number, location, and pattern of jets are not critical. For optimal penetration rate and economical operation, the hydraulic fluid is distributed so that only a minimum hydraulic energy required is directed to suspending and removing loosened particles from the nozzle through conduit 4. The remaining hydraulic energy is directed through primary nozzles to loosen compacted particles. Penetration rate of the hydraulic nozzle is determined by the force pushing the nozzle into the soil strata, the cutting force of the hydraulic fluid, and the lifting capacity in the evacuation conduit. With an optional airlift system, line 13, FIG. 2, to inject air into a substantially vertical evacuation conduit, the minimum hydraulic fluid flow rate required to remove loosened soil is low. The gas or air should only be injected in the evacuation conduit because lower fluid density and phase separation problems will reduce the cutting efficiency of the hydraulic fluid projected through the hydraulic jets. The air flow rate and pressure are not critical, but for the embodiment shown in FIG. 2 the preferred ranges for air are 100–600 cfm at 100–600 psig. A minimum of 50 psig air pressure should be maintained over the hydraulic head. Air is simply injected into the evacuation conduit near the nozzle by an auxiliary air line to increase the lifting capacity and fluid velocity in the evacuation conduit. Air can also be injected at various points along the evacuation conduit. Other gases, such as natural gas, $CO_2$, or $N_2$, can also be used for special applications.

Hydraulic jets can be arranged in several patterns to obtain a desired hydraulic fluid distribution and velocity. In view of the teachings herein, variations of these patterns will be apparent to those skilled in the art. A preferred nozzle arrangement is illustrated by FIG. 2 which shows primary nozzle 5 and secondary nozzle 7 arranged in a single circular pattern about the evacuation conduit. The primary nozzles having an angle of inclination of 90° project fluid toward the cutting face, while the secondary nozzles have an angle of inclination of greater than 90°, specifically about 105° so that they project fluid which serves both to loosen particles at the cutting face and to suspend them in the envelope. In a preferred arrangement the angle of inclination of the jets about this circular pattern vary sequentially according to the pattern of about 90° and 105° with from about eight to 12 nozzles and preferably 10 in the pattern. In another preferred pattern, the angles of inclination vary sequentially about the pattern from about 75°, to about 90°, to about 105°. A preferred embodiment of the nozzles, as shown in FIG. 2, has a length (L) of about 3 feet, a diameter (D) of 2 feet, and an evacuation conduit having a diameter (*d*) of 8 inches, with ten ½-inch diameter jets arranged about the evacuation conduit according to the above pattern and as shown.

As shown in FIG. 5, another preferred arrangement of hydraulic jets has the jets in three circular patterns about the cutting envelope. The primary jets are large orifices near the front of the conical partition which focus hydraulic fluid at the cutting face. The secondary jets 7 are small orifices spaced around the conical partition to disperse and remove granular particles from the cutting envelope through evacuation conduit 4. For this nozzle a large number, about 12–48, of primary jets are desirable for a high penetration rate. As shown in FIG. 5, the primary jets have an angle of inclination of about 35° while the secondary jets have an angle of inclination of about 20°.

The cutting nozzle of this invention can be fabricated from the standard materials, such as standard size pipe and sheet metal. They can also be fabricated of special materials for particular applications. For the embodiments shown and labeled in FIGS. 2 and 4, the preferred dimension ratios are shown as follows: L/D ratio about 1.0–3.0, preferably about 1.5; D/*d* ratio about 3.0–6.0, preferably 4.0; and D/P ratio about 1.5–4.0, preferably about 2.0. For hard soil formations a low L/D ratio is preferred. For these nozzles, the hydraulic fluid flow rate should be about 200–700 gallons per minute. A minimum of 6 gallons per minute should be circulated to keep the jets clear. Velocity through the hydraulic jets should be about 200–2500 feet per second (fps). Primary or cutting jets should have a velocity of about 400–2500 fps. Secondary or dispersing jets should have a velocity of about 200–600 fps. Hydraulic fluid flow can be regulated by pressure. For the preferred embodiment in FIG. 2, the pressure range is about 250–300 psig. A single jet can serve both a primary and secondary function or have a dual function.

A jet can be either a long nozzle type as shown in FIG. 2 or a simple orifice type as shown in FIG. 5. A long nozzle type jet can be used to project a high velocity stream over a long distance. The orifice type jet is simple and can be used to deliver a high volume stream from a short distance.

I claim:

1. A hydraulic nozzle for setting a hollow piling in a subsurface soil formation comprising:

a. a cutting envelope formed by a sheath of generally circular cross section open at its front end and partially closed at its rear end by an annular partition;

b. an evacuation conduit extending rearwardly of said annular partition and providing fluid communication from the interior of said cutting envelope through said annular partition;

c. first hydraulic jet means adapted to project hydraulic fluid toward the front opening of said sheath;

d. first hydraulic fluid conduit means for supplying hydraulic fluid to said first hydraulic jet means;

e. reverse hydraulic jet means projecting rearwardly from said nozzle and adapted to remove soil from above and maintain clearance behind said nozzle; and f. secondary hydraulic fluid supply means for providing hydraulic fluid to said reverse hydraulic jet means.

2. The hydraulic nozzle of claim 1 wherein said first hydraulic jet means comprises a plurality of hydraulic jets arranged in a plurality of circular patterns.

3. The hydraulic nozzle of claim 1 wherein said sheath is cylindrical, said annular partition is perpendicular to said sheath, and said first hydraulic jet means are mounted on said annular partition.

4. The hydraulic nozzle of claim 1 wherein said sheath is larger in diameter at its front than at its rear.

5. The hydraulic nozzle of claim 1 wherein said annular partition is a conical partition extending from the front of said sheath to said evacuation conduit, and said first hydraulic jet means includes orifices near the front of the conical partition adapted to focus hydraulic fluid toward the cutting face thereof and orifices near the rear of said conical partition.

6. The hydraulic nozzle of claim 1 wherein said cutting envelope comprises two concentric cylindrical sections and a said first hydraulic jet means includes jets at the front and rear of said cylindrical sections.

7. The hydraulic nozzle means of claim 1 including a pneumatic fluid supply line adapted to inject air into said evacuation conduit rearward of said cutting envelope.

* * * * *